US009707594B2

(12) United States Patent
Wooldridge

(10) Patent No.: US 9,707,594 B2
(45) Date of Patent: Jul. 18, 2017

(54) LEAD AND RUBBER RECLAMATION APPARATUS AND PROCESS

(71) Applicant: Fred Wooldridge, Brownsville, CA (US)

(72) Inventor: Fred Wooldridge, Brownsville, CA (US)

( * ) Notice: Subject to any disclaimer, the term of this patent is extended or adjusted under 35 U.S.C. 154(b) by 0 days.

(21) Appl. No.: 14/545,020

(22) Filed: Mar. 17, 2015

(65) Prior Publication Data

US 2016/0273890 A1 Sep. 22, 2016

(51) Int. Cl.

| | |
|---|---|
| ***B07B 9/00*** | (2006.01) |
| ***B07B 9/02*** | (2006.01) |
| ***B07B 7/086*** | (2006.01) |
| ***F41J 11/00*** | (2009.01) |

(52) U.S. Cl.
CPC ..... *B07B 9/02* (2013.01); *B07B 7/086* (2013.01); *F41J 11/00* (2013.01)

(58) Field of Classification Search
CPC ..... B07B 9/00; B07B 9/02; B07B 7/086
USPC ..... 209/12.1, 31, 710, 712, 723
See application file for complete search history.

(56) References Cited

U.S. PATENT DOCUMENTS 4,222,529 A * 9/1980 Long ..... B04C 5/26 209/17
5,030,259 A * 7/1991 Bryant ..... B01D 50/002 15/340.1
5,163,786 A * 11/1992 Christianson ..... B65G 53/60 406/109
5,453,196 A * 9/1995 Tuszko ..... B01D 45/12 209/715
5,732,829 A * 3/1998 Smith ..... B07B 4/02 209/135
5,996,171 A * 12/1999 Bowers ..... B01D 46/002 15/340.1
8,051,986 B2 * 11/2011 Lees ..... B07B 4/02 209/138
8,657,910 B2 * 2/2014 Park ..... A47L 9/1683 55/337
9,131,818 B2 * 9/2015 Peace ..... A47L 9/1625

* cited by examiner

*Primary Examiner* — Terrell Matthews
(74) *Attorney, Agent, or Firm* — Mark C. Jacobs

(57) ABSTRACT

An apparatus and process for reclamation of indoor and outdoor gun ranges, wherein a mixture of rubber chunks, lead pieces, and trash from the range are fed into a first cyclonic separator for the removal of the lead. The rubber and trash are segregated and moved from the first cyclone to a second cyclonic separator, for separation of the rubber from the trash, while the trash is passed to a filter system. In the filter system, the trash is removed and drops out through a rotary valve at the bottom of the filter, leaving the air to be removed out the top of the filter system to be moved by suction through a Roots type blower to become pressurized air to distribute the rubber particles coming from the second cyclonic separator, back to the range or into collection in bags.

5 Claims, 12 Drawing Sheets

LEAD AND RUBBER RECLAMATION APPARATUS AND PROCESS

RELATION TO OTHER PATENT APPLICATIONS

Priority is claimed from U.S. Provisional Application 61/967,564 filed Mar. 19, 2014

FIELD OF INVENTION

This application relates to an apparatus system, which can be disposed in a trailer or truck mounted, for easy movement from place to place for the separation of rubber and lead from other trash primarily on the grounds of outdoor gun shooting ranges, but indoor ranges can be serviced as well, by parking the trailer adjacent to the indoor facility.

BACKGROUND OF THE INVENTION

Since about 1990, many outdoor public shooting ranges in Government-owned facilities and parks in the United States have been temporarily closed due to concerns over lead contamination of the earth and ground water contamination as well. Many of these ranges were poorly designed and lack the Surface Danger Zones required for safe operation. Though they might have existed in this form for many years, encroachment from residential and commercial growth along or near property lines have increased concerns over safety by the general public. Privately owned facilities have largely gone unbothered by recent regulatory changes. However that does not mean that private indoor and/or outdoor ranges are immune from environmental issues.

Many indoor and/or outdoor ranges use granulated rubber having chunks of rubber of about 1 to 2" by about 1 inch spread out in the area behind the targets to slow down and stop the movement of the speeding bullets fired by shooters that either hit or miss the target(s). The granulated rubber can be in front of a dirt berm or instead of a dirt berm. The result either way is that spent bullets and large fragments of lead get mixed in with the granulated rubber. Also paper, trash and other debris can collect in the target area as well, especially in the outdoors.

To date there has been no easy and low cost way to separate the lead from the rubber effectively. The only patent known to applicant for remediation of contaminated soil and other materials by lead particles is U.S. Pat. No. 7,368,043 issued to Mohanta et al. But this patent requires the use of an electrochemical cell and harsh chemicals, such as ethylene diamine tetraacetic acid (EDTA). Other methods employ the collection and replacement of the dirt in the target area and the disposal of this dirt as a hazardous material. But collecting and dumping does incorporate a separation step of the lead from the rubber and other non-wanted materials such as paper, foam and cigarette butts. Thus the profitable lead resale is forgone.

There is therefore the need for a procedure to clean up gun ranges which incorporates the ability to separate the rubber and trash from the lead which can bemelted down and reused. It would also be beneficial to the range owner to recoup some, or much of the rubber that had formerly been thrown away due to lead contamination.

Applicant is not the only company in the remediation field. MT2, LLC of Arvada Colo. is engaged in the business of range cleaning, but a reading of their materials indicates that the company's thrust is lead contaminated soil treatment technology to protect the environment by preventing lead from leaving the range using their Ecobond® coating system. Lewis Environmental group offers remediation solutions for various environmental problems. However, they are more focused on abating emergency situations, like oil spills.

There is a need therefore for a low cost recovery system that can be used to remediate the granulated rubber and remove the lead therefrom. Applicant has worked for many years and has finally developed such an apparatus that can easily be moved around from range to range since it can be mounted in a closed van or on a flatbed truck or on a trailer as may be desired. While any of these three transporting modes can be employed to go from range to range, it is strongly suggested that due to the high cost of the various components of the system, that a lockable enclosed space be employed such as a trailer or enclosed truck.

One achievement that applicant has accomplished is the removal of unburned gun powder residue from the range as part of the trash removal, something others can not do and have not done. Other trash items removed that are also combustible include tiny cardboard and paper fragments.

SUMMARY OF THE INVENTION

A truck or trailer mounted system of various components that interact to separate the lead pieces from the rubber chunks and other debris, followed by a separation of the rubber from the other debris. The lead is collected for recycling for which cash can be obtained, while the rubber is returned to the range, and optionally in a variant the rubber fines, which are small particles, are collected for disposal along with the other debris be it paper, foam, leaves etc.

It is a first object to provide an apparatus which is basically a system of separate components each of which does a separate job to achieve the desired result of remedation of a gun range.

It is a second object to segregate rubber left fines, from large chunks and smaller size particles of rubber found at gun ranges during range cleanup.

It is a third object to provide an apparatus that optionally includes a separator screen to discriminate between particle sizes of rubber and then permits separation of large from small size rubber particles, with the fines to be disposed of and the large chunks returned to the range.

It is a fourth object to provide an apparatus to segregate foam, paper, leaves and other disposables from the rubber chunks to be ultimately returned to the range floor.

It is a fifth object to provide a process for cleaning up gun ranges of the lead remnants mixed with large and small size rubber particles, and undesirable waste, to permit the large rubber particles to be returned to the range site free from debris.

It is a sixth object to provide a low cost process for indoor and outdoor gun range remediation.

Further objects of this invention will become apparent from a careful reading of the detailed description provided herein as well as from a review of the drawings

DETAILED DESCRIPTION OF THE PREFERRED EMBODIMENT

Figure 1:
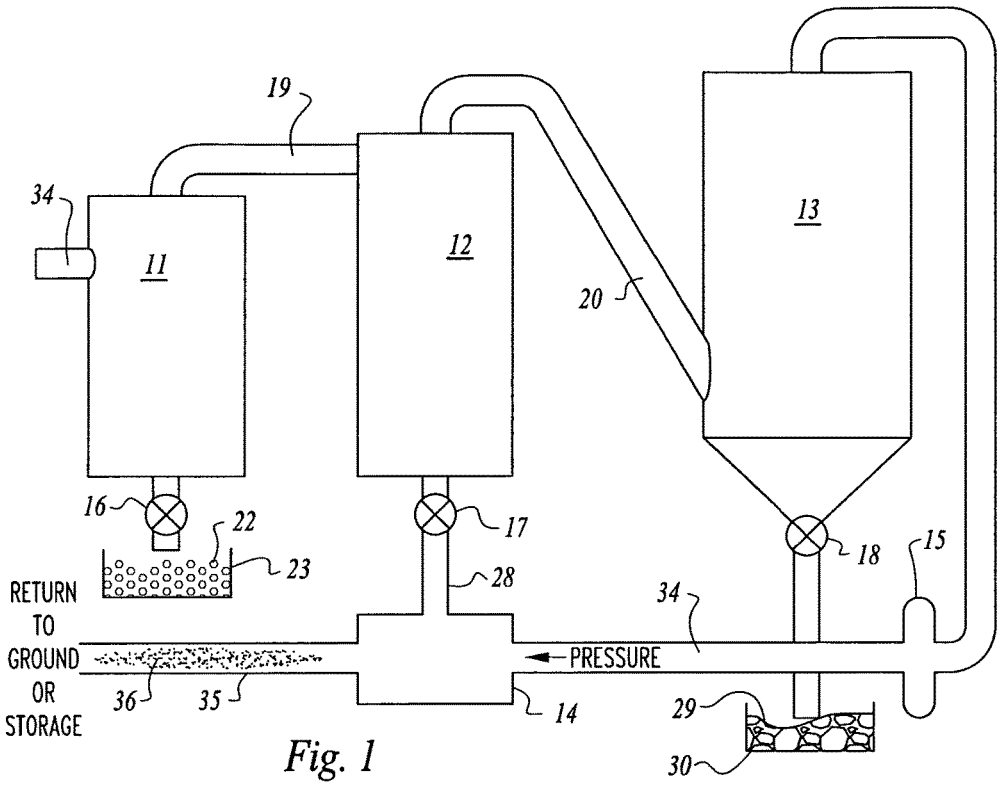
FIG. 1 is a diagrammatic view of the interconnected components that make up the system of this invention.

Prior to discussing the various components individualy that make up the system of this invention, there will be a discussion of the PROCESS and the variant of the process. Turn now to FIG. 1. An inlet pipe from the gun range brings in a mixture of air, lead, rubber chunks, rubber fines, foam from coffee cups, scrap paper, leaves and other debris normally found in outdoor environment by suction. The inlet pipe 25, leads to stage 1, a cyclonic separator, 11, where the lead is separated out from the rubber and the undesirables which we shall simply call trash. Since the lead is heavier than everything else, it drops down into rotary valve 16 for collection as in bin 23 wherein chunks of lead and an occassional shell casing are collected. The rubber and the trash, escape upwards again via a controlled suction, through outlet 19 to the second stage designated 12, which is also a cyclonic separator. Here the same principle is applied. The rubber being heavier than the trash goes down the separator and out the rotary valve 17 via pipe 28 to a drop chamber 14. From chamber 14 the rubber takes a path to be discussed infra. The trash being relatively light goes up and out the second cyclonic separator via outlet pipe 20 into the third stage 13 which is an air filter system that preferably uses cartridge filters as will be discussed below. All three stages are fluidly connected during operation.

The trash, leaves foam etc, drops down through the rotary valve 18 into a trash bin 28 for ultimate collection. Meantime only air comes out the top of the air filter via pipeline 21 to the Roots type blower. The details on a Roots blower will be discussed in the section of the paplication pertaining to the hardware components.

The air only, under pressure from the Roots type blower enters the drop chamber 14 to move the isolated rubber chunks for either collection in bags or boxes or for redistribution onto the gun range itself. The rubber chunks without fines are designated 110.

Figure 1A:
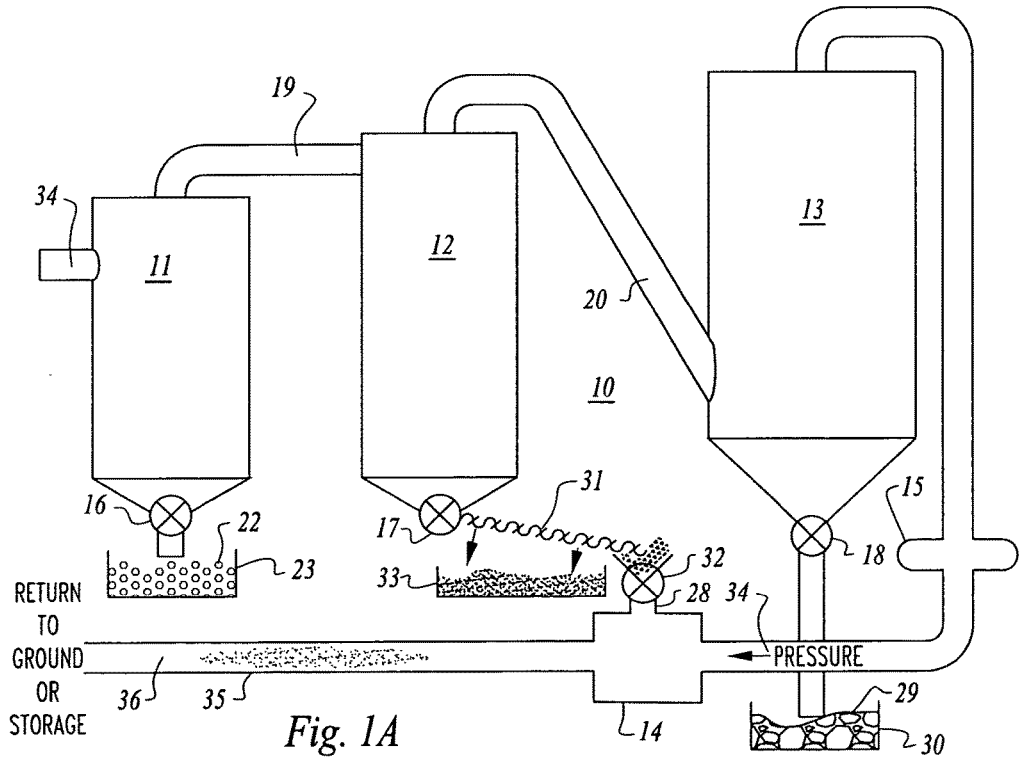
FIG. 1A is a diagrammatic view of a variant of the interconnected components that constitute the system of this invention.
Figure 27:
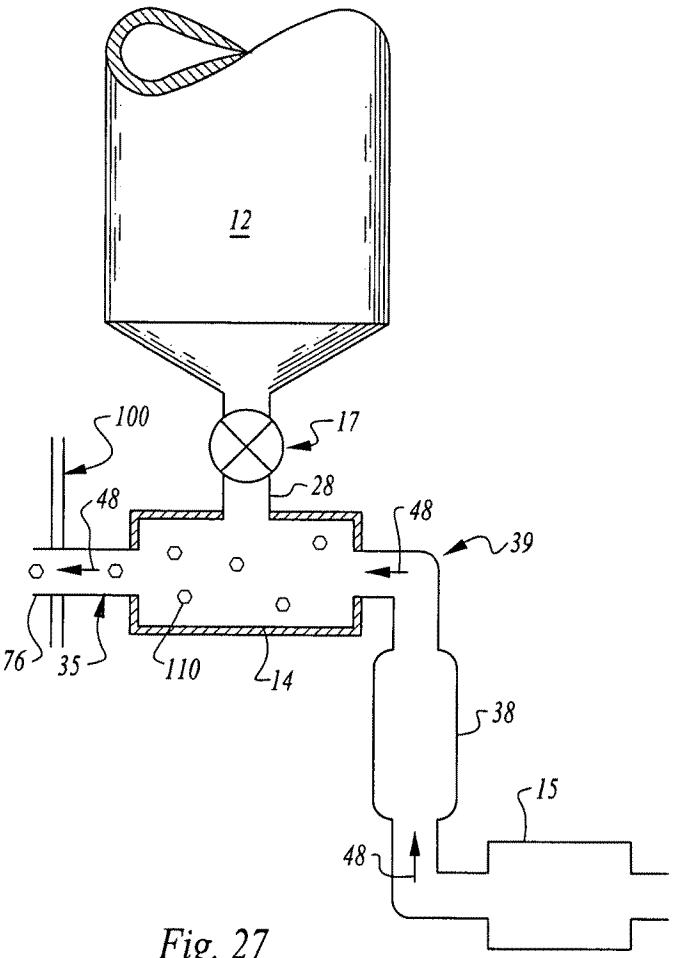
FIG. 27 is a diagrammatic view of the area beneath the rotary valve discussed with respect to FIG. 11.

FIG. 1A is basically a repetition of the process of FIG. 1 but for an added component, screen separator 31. In the first process, no attempt is made to classify the rubber into big or small pieces But here in FIG. 1A when the rubber emerges from rotary valve 17 it passes onto a screen, 31 where the fines will fall through the screen for collection into bin 33 for disposal, while the chunks of a predetermined size minimum,—depending upon the size of the openings in the screen—will be transported down along the screen to the rotary valve 32 for delivery to the drop chamber 14 via inlet 28, which is also the outlet from rotary valve 32. The movement of the collected rubber chunks is the same as was discussed relative to FIG. 1. Suitable size sorting screens are available in the marketplace for various types of particle size separation. For the process of FIGS. 1 and 1A, the drop chamber 14 has an inlet of blowing air pressure from the blower to move the chunks of rubber 110 out of the chamber via hose 35, which connects to the outlet 76 shown on the trailer in FIG. 6 for return of rubber chunks to the range. See also FIG. 27 discussed infra. (Little or no fines are here due to he filtering step)

Returning to the process of FIG. 1A, the trash comes out the bottom of the air filter stage 13 via rotary valve 18 into trash collection bin 30, wherein one typical leaf collected is designated 29.

It should be mentioned that Roots blowers can be very noisy, especially when located in a confined space such as a truck or trailer. Thus in the discussion of the various components employed herein a cylindrical silencer is used in line with the Roots blower to lower the decibel range to an acceptable level for the workers involved with the operation. But as noted, the process as set forth in FIGS. 1 and 1A are fully operable, but more than likely would employ the optional noise reducing silencer to lower the decibel level.

Figure 2:
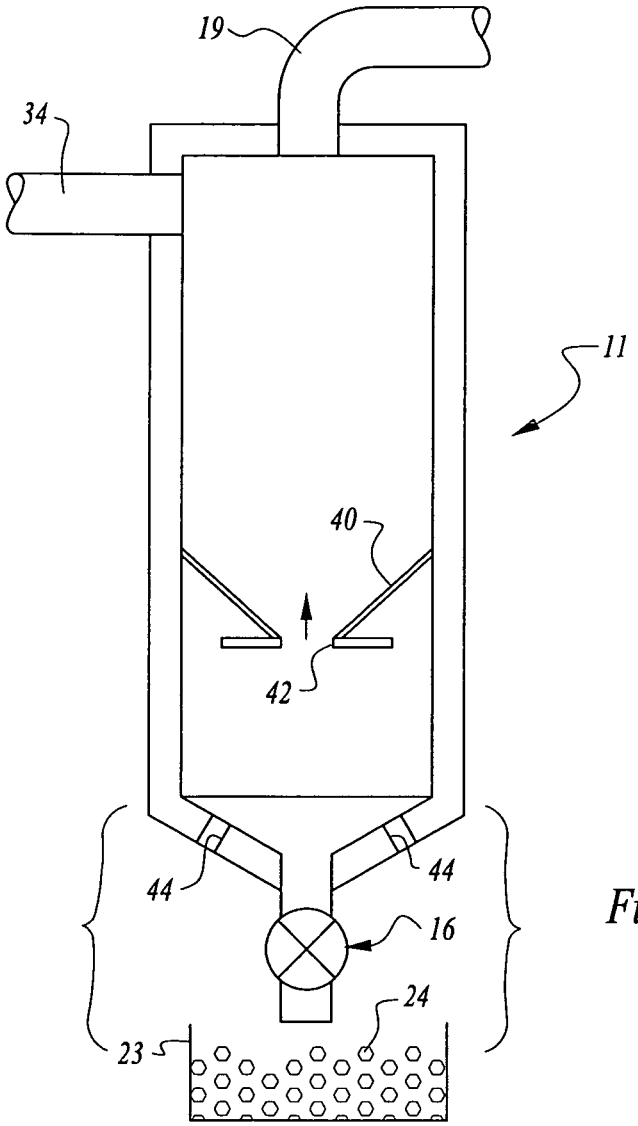
FIG. 2 is a cutaway view of one of the components of this invention.
Figure 3:
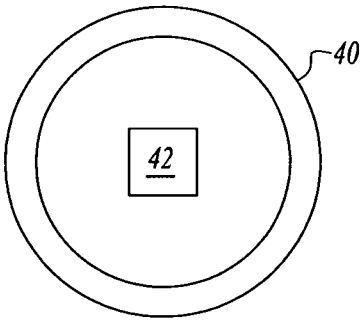
FIG. 3 is a top plan view of an element seen in elevation in FIG. 2.
Figure 25:
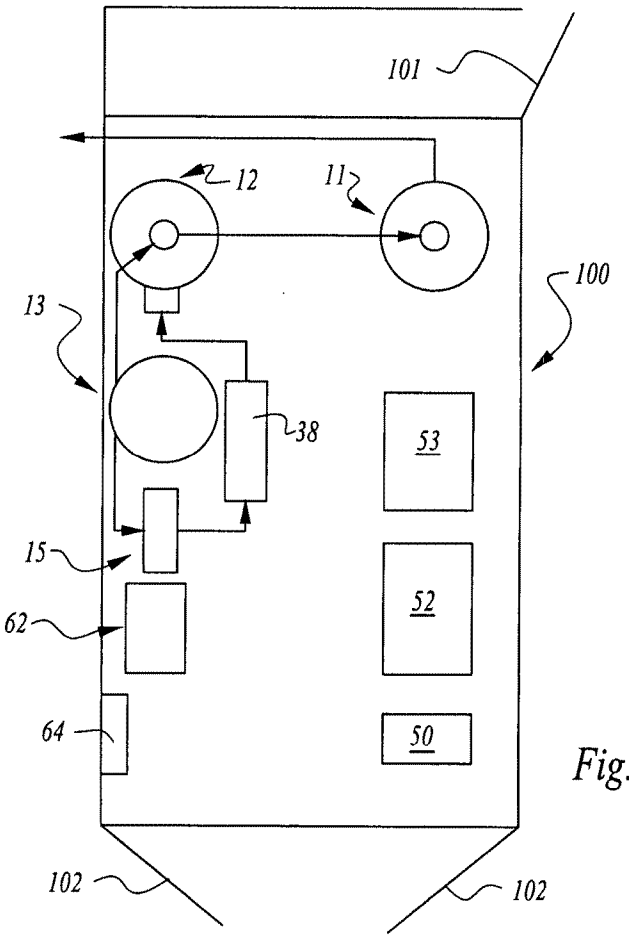
FIG. 25 is a top plan diagrammatic view of the trailer and the components disposed therein and showing only some of the connections, for ease of understanding.

Now having understood the process in general, we turn to the system components in particular commencing with FIG. 2. But let us pass on the discussion of FIGS. 2 and 3 currently. Refer instead to FIG. 25 which is a top plan diagrammatic view of the actual components shown in the trailer. In point of fact these are all of the key components shown in FIG. 1, as well as some ancillary components used to actuate and control the working components shown in that figure. Since the numbering of the parts in FIG. 25 is for reference only, discussion of these will be withheld until each component which is carries the same part number is discussed. The overhead view is for ease of understanding only, for the reader and has been simplified with certain omissions, such as motors & gear trains etc.

Figure 4:
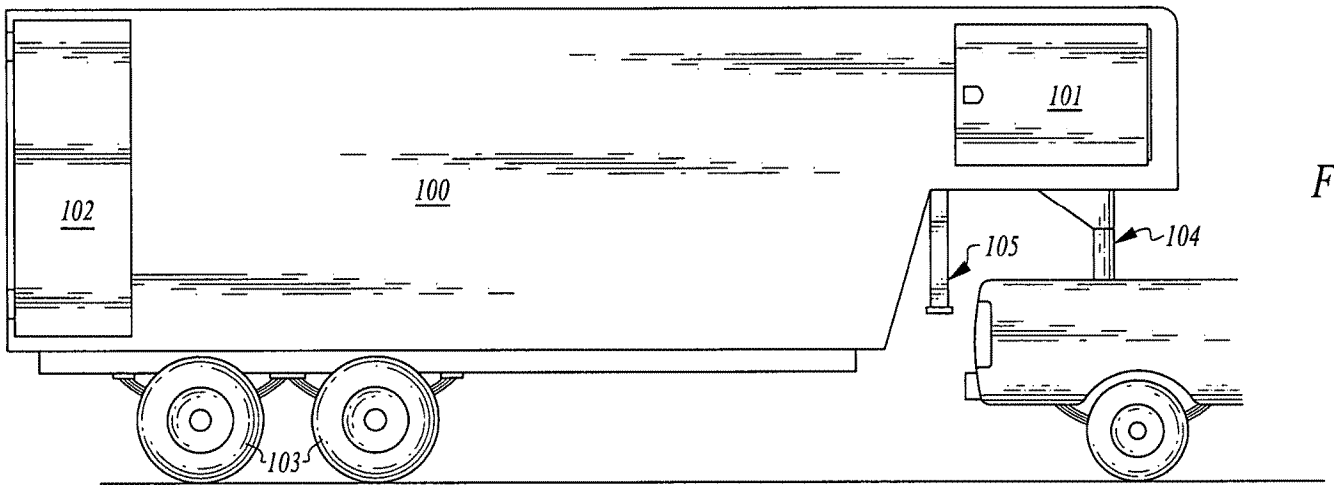
FIG. 4 is a right side elevational view of the trailer housing the components of the inventive system.

We now turn to FIG. 4. FIG. 4 is a right side elevational view of the trailer forming part of this invention. Trailer 100 has a main body, with a pair of side hinged doors 102. A forward section 111 has an access hatch 101 to enable ready access to the storage area located above the stanchions and $5^{th}$ wheel connection 104 to the unnumbered truck See also FIG. 11. Since the components in the trailer are quite heavy, a double axle 103 is employed to help carry the weight.

Figure 5:
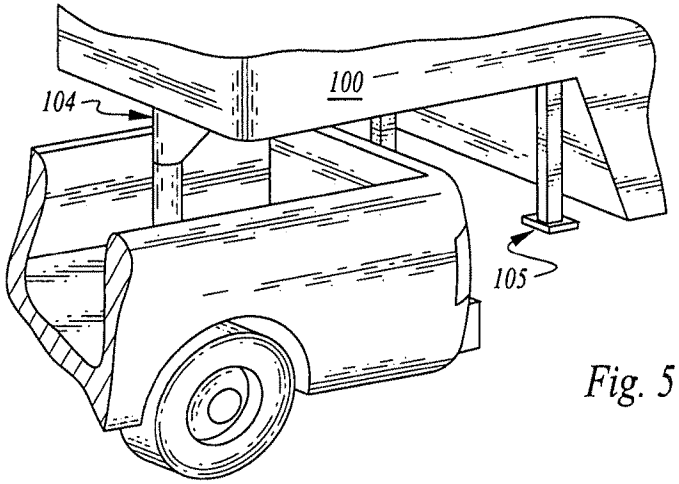
FIG. 5 is a perspective closeup view of the forward portion of the trailer seen in FIG. 4.

FIG. 5 is a left side perspective of the frontal area of the trailer. Both the stanchions (jacks) 105 and the fifth wheel connection 104 are conventional. Note the presence of element 112 adjacent the stanchion flat plate. That is the rubber dropped to return from the system to the gun range.

Figure 6:
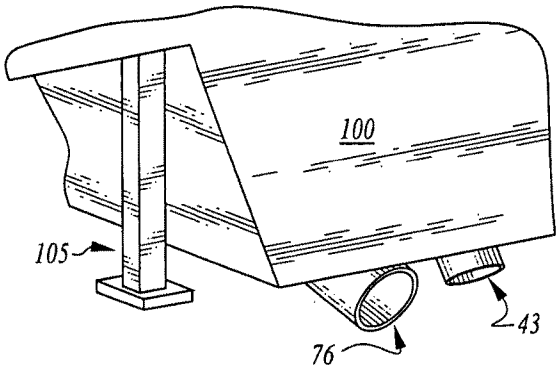
FIG. 6 is a closeup view of the lower left corner of the trailer and the supporting jacks employed therewith.

FIG. 6 is a left side elevation view of the lower area of the trailer front. The forward tube or hose, 76 is the intake into the system for the rubber, lead, etc from the range. Hose 76 connects directly to the first stage of separation which is the segregation of the land from the rubber and trash. Discussion of this operation will be had infra when we discuss the first cyclonic separator. The rightwardly connection 43 is for the air coming from the Roots Blower with large rubber chunks to be returned to the gun range.

Figure 7:
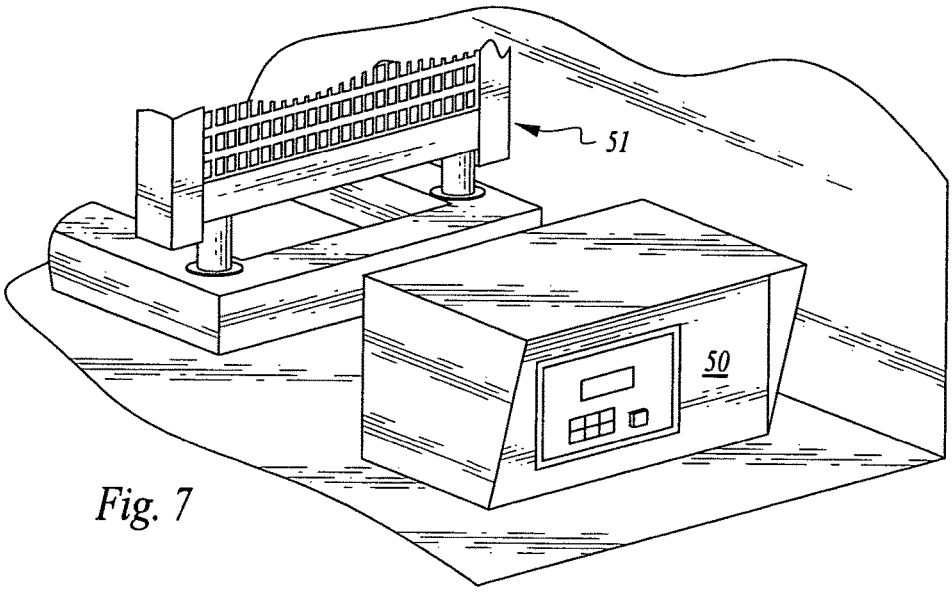
FIG. 7 is a perspective view of the starter employed with the first or right engine.
Figure 8:
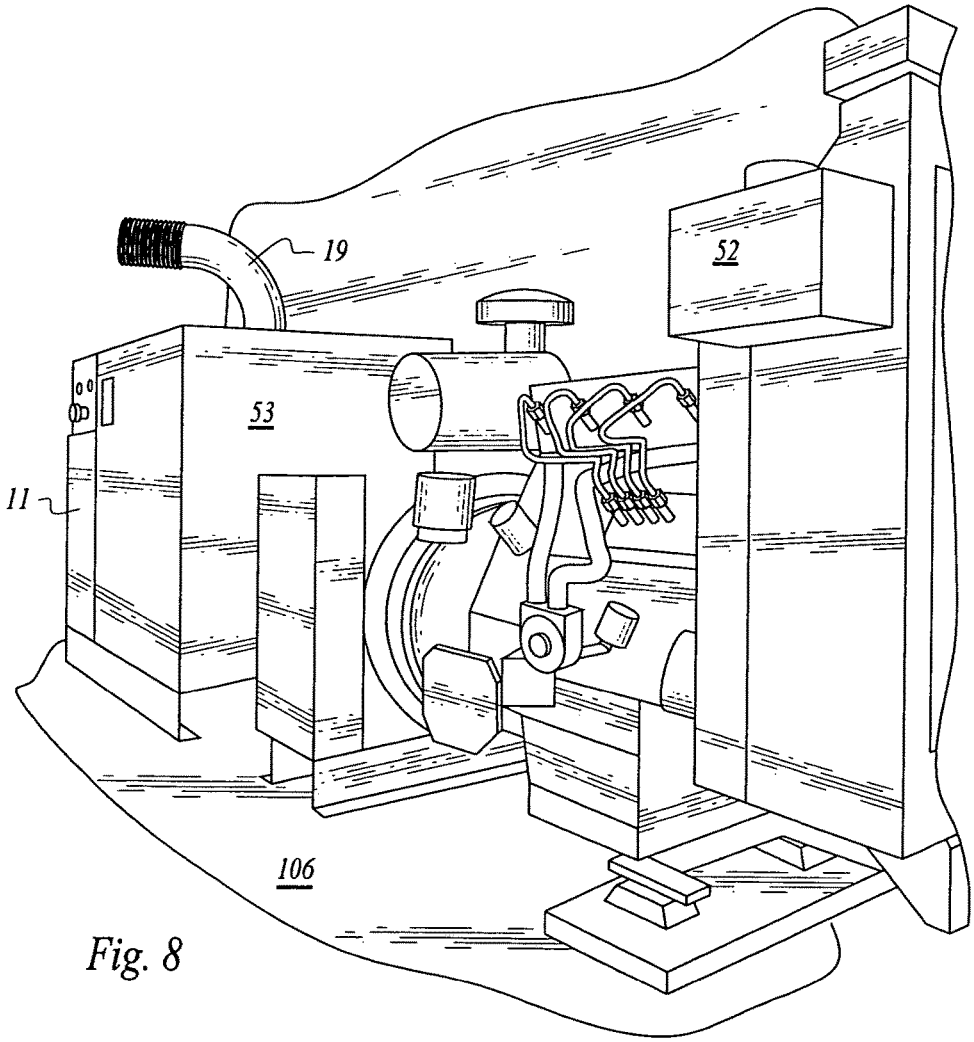
FIG. 8 is a perspective view of the side diesel engine and the screw compressor employed herein, disposed in the trailer.
Figure 9:
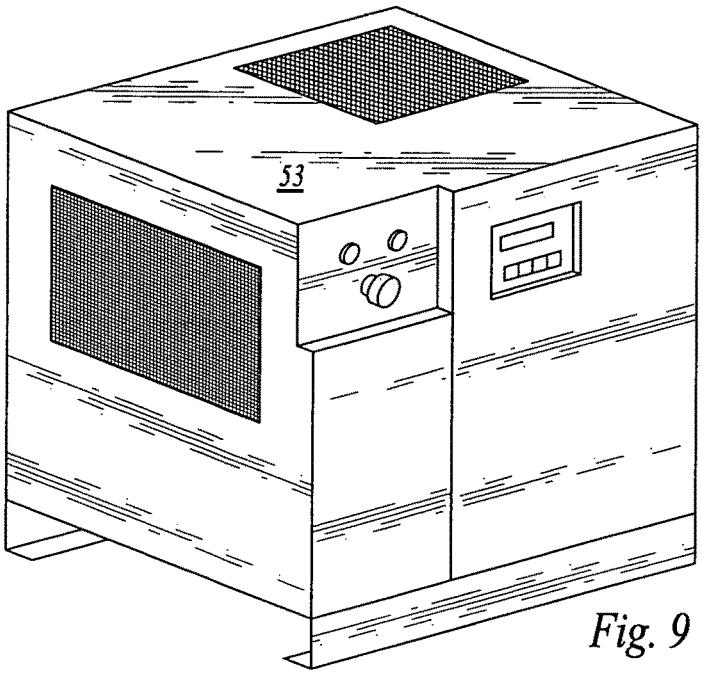
FIG. 9 is a perspective view of the compressor.

In FIG. 7, the rear entryway of the trailer is seen. The first item seen is the generator starter 50. This is an off-the-shelf generator starter and is utilized to reliably provide power to a generator engine's starting motor. Genstart, the brand on starter 50 is a trademark of Active Power Corporation. The diesel engine 52 is seen only in part in FIG. 7. It's function is to supply power to the screw compressor 53. This unit 53 mounted to trailer floor 106 should be a 5 to 7.5 horse power screw compressor A rotary screw compressor is designed to reduce energy consumption and costs as compared to piston compressors. It is particularly popular in industrial applications because it can run 24 hours a day without the danger of overheating. In the environment of this invention a screw compressor in the range of 5 to 7.5 hp is recommended. The compressor provides air pressure for the cyclonic separators of this invention. The operation of a screw compressor is well known and need not be discussed further. Please note that the air compressor though a vital component of the system of this invention is not shown in FIGS. 1 and 1A to avoid clutter in the views, as well as because their need and operation are well understood. The air compressor 53 is present to supply air to clean the multiple filter cartridges in the air filter stage 13 sequentially. There may between 2 to 6 cartridges in the filter unit.

Figure 10:
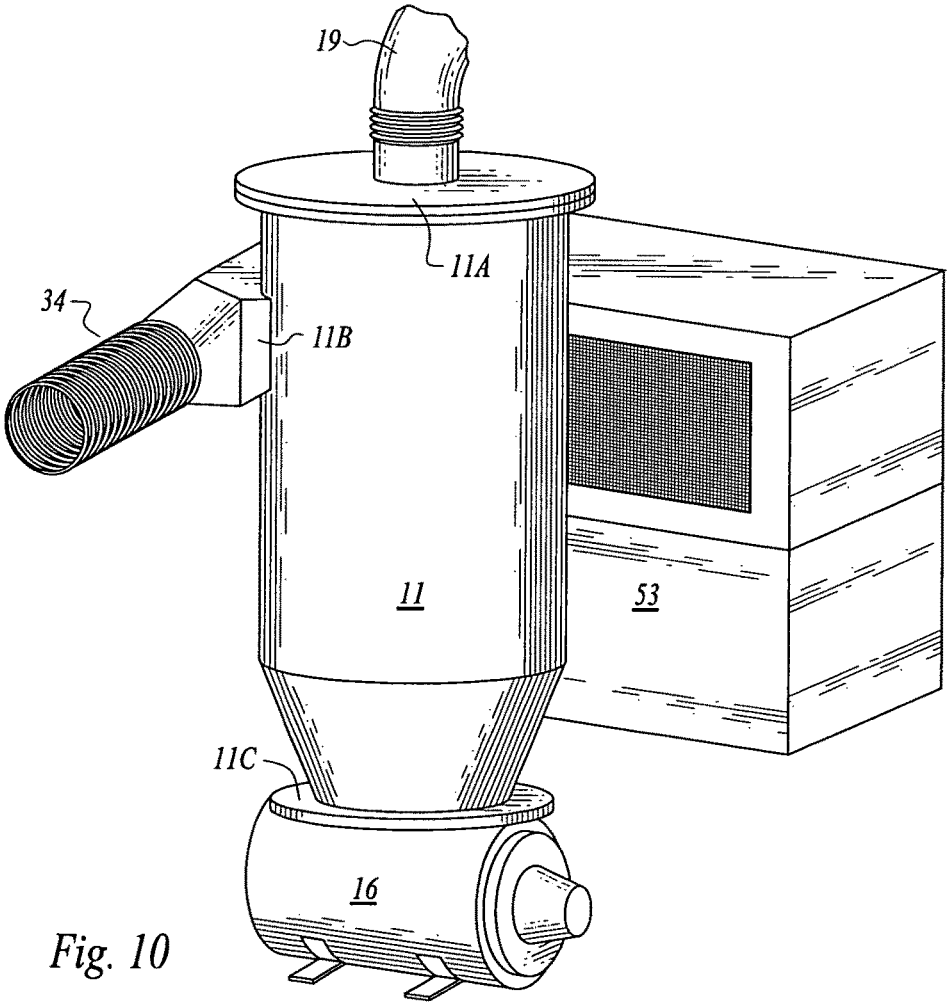
FIG. 10 is a perspective view showing the first cyclonic separator adjacent to the compressor.

The discussion now moves to FIG. 10 wherein the first stage cyclonic separator is seen adjacent the screw compressor. The cyclonic separator 11 includes an inlet hose 76 that comes in from the outside of the trailer to deliver lead, rubber, and trash which is a mixture of foam, paper leaves etc. which are all undesirable. Cyclonic separator 11 also includes an outlet pipe 19 that leads to an to the 2nd stage separator which will be discussed infra. See FIG. 2 also Cyclonic separation is a method of removing particulate from an air, gas or liquid stream, without the use of filters, through vortex separation. Rotational effects and gravity are used to separate mixtures of solids and fluids usually a gas such as air. Air flows in a helical pattern, beginning at the top (wide end) of the cyclone and ending at the bottom (narrow) end before exiting the cyclone in a straight stream through the center of the cyclone and out the top. Larger (denser) particles in the rotating stream have too much inertia to follow the tight curve of the stream, and strike the outside wall, then fall to the bottom of the cyclone where they can be removed. In a conical system, as the rotating flow moves towards the narrow end of the cyclone, the rotational radius of the stream is reduced, thus separating smaller and smaller particles.

A motorized rotary valve, is disposed beneath and connected to the bottom outlet of the cyclone. In this first stage the rubber particles and the trash will exit out pipe 19 to the second stage of separation, 12. The lead material being much denser and heavier than the rubber or trash falls the bottom of the rotary valve 16. The cyclonic separator of the first stage of this invention is not a typical off-the-shelf cyclonic separator.

Reference can now be made to FIG. 2 which is a cutaway view of the stage I—lead—separator. As noted with reference to FIG. 10, the input pipe 34 is seen entering on the side of the separator. The exhaust is designated 19 at the top of the unit. A review of FIG. 2 shows that this is a cutaway view wherein a bowl shaped plate 40 having a central preferably square shaped opening 42 therein, is internally attached to the wall of the cyclone 11. At a location within the housing wall of the stage I cyclonic separator, at an elevation below the square opening of the bowl shaped plate are a series of about four ⅜" openings set out in a ring configuration through the cyclonic separator chamber wall, designated 44 to aid in fluid flow and to help the particles, large and small of rubber to rise upwardly toward exhaust port 19. To ensure high efficiency of the first separation, the opening 42 in the bowl shaped plate 40, should be slightly smaller than the output hose 19

It is to be understood that the input 34 shown in FIGS. 1,1A and 2 is connected to the hose 76 from outside of the trailer. Also the output fluid line should be of a greater diameter than the opening in the bowl shaped plate by 1 to 2 inches Again with reference to FIG. 10, a motorized rotary valve 16 is shown beneath the first stage separator. Whereas in the operation of the trailer the lead particles are dropped out of an opening in the bottom of the rotary valve, here in the diagram the lead is also shown dropping into a collection bag. Note the chunks of lead are designated 22 in bag 23.

Referring once again to FIG. 10, it is seen that the cyclone is a topically 11A and a bottom section 11C, which letter section is interposed between the cyclone body 11 and rotary valve 16. Designator 11B is the connection port for the incoming hose 34 from the exterior of the trailer. It is to be noted that both stage I and stage II are operated by separate chain drives connected to motors conventionally, one of which is visible in part in FIG. 10 and designated 55.

Figure 11:
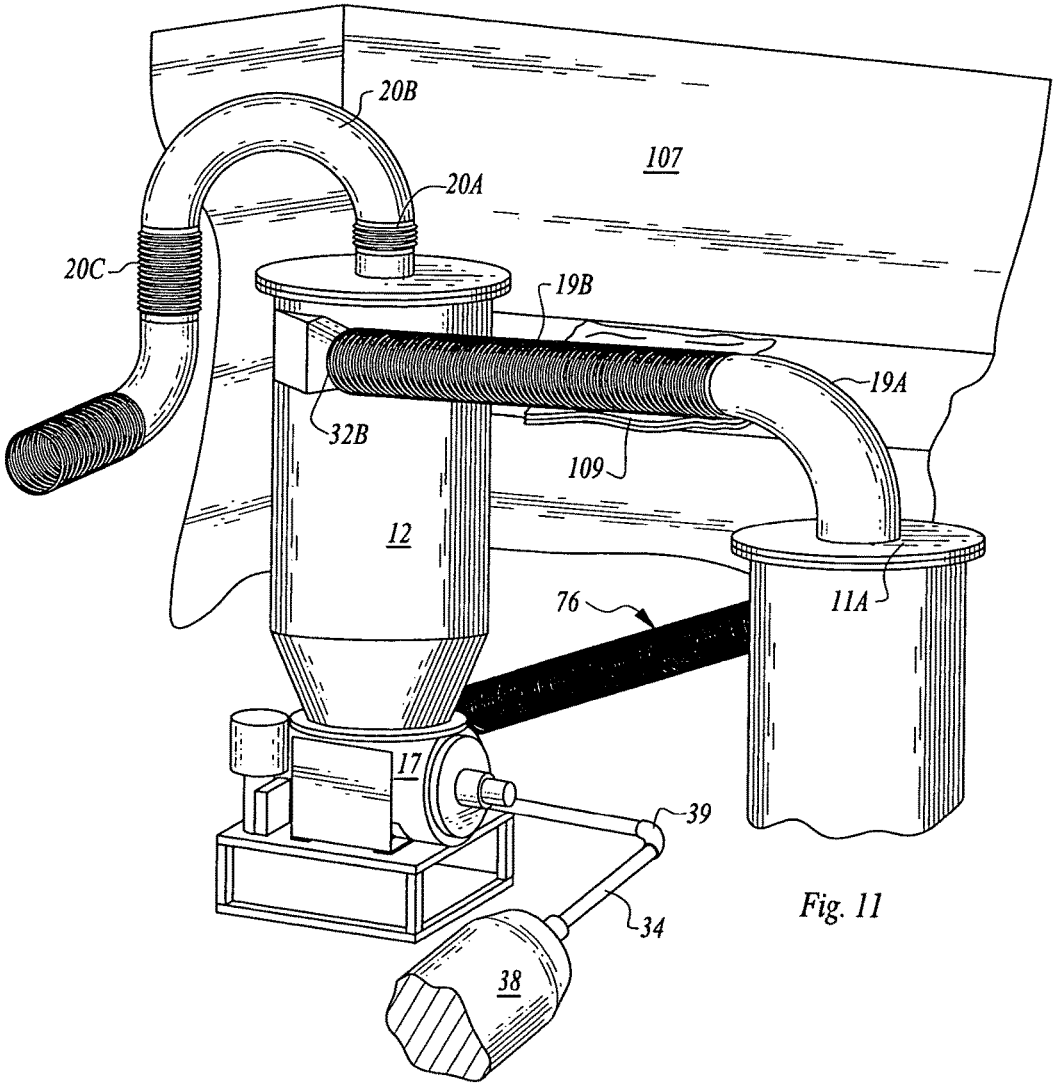
FIG. 11 is a perspective view of the rear portion width of the trailer showing cyclonic separator #1, and its connection to cyclonic separator #2, and the input hose to separator #1 from the outside.
Figure 12:
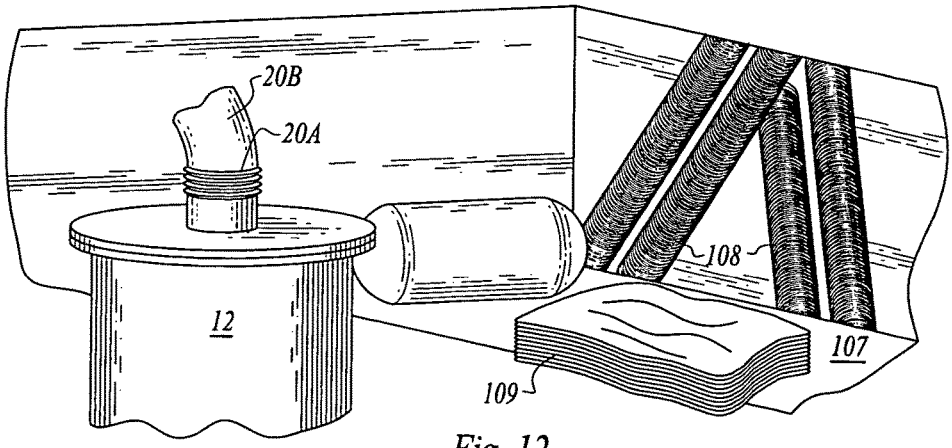
FIG. 12 is a partial perspective view of the forward section of the trailer above the jacks which is used for storage, as well as showing a portion of separator #2.

In FIG. 10 only part of the exit connection from stage I, 11 to the stage II designator 12 is seen. But reference to FIG. 11 shows that this connection 19 consists of metal elbow 19A, connected to a flexible hose 19B which hose 19B terminates at input port 12B of the second stage, 12. All flexible hose used herein is smooth on its interior surface.

The stage II cyclone is a conventional cyclone whereby the rubber particles exit the cyclone into rotary valve 17 for collection and all the trash goes out the top through exit pipe 20. Exit pipe 20 consists of a flexible junction connected 20A connected to element 12A which is a top plate exit port of the second stage. Fluidly connected to 20A, the flex tubing is large U-shaped tubular member 20B and a larger flexible section 20C that connects itself on its second end to the rigid pipe elbow 20D. Elbow 20D is the input to the third stage, which is the air filter, designated 13. Since the area under the rotary valve 17 can be adequately viewed from the vantage point of FIG. 11, reference should be made to the diagram of FIG. 27 which shows the blowing fluid connection from the blower 15 through the silencer 38 into output line 39 from the silencer into the drop chamber which is a small area beneath the stand—unnumbered upon which the rotary valve 17 is disposed. The incoming air under pressure shown by arrow 48 pushes the pieces of rubber 110 out internal hose 35 that connects with the exhaust port 76 shown on the outside of the trailer wall.

Figure 13:
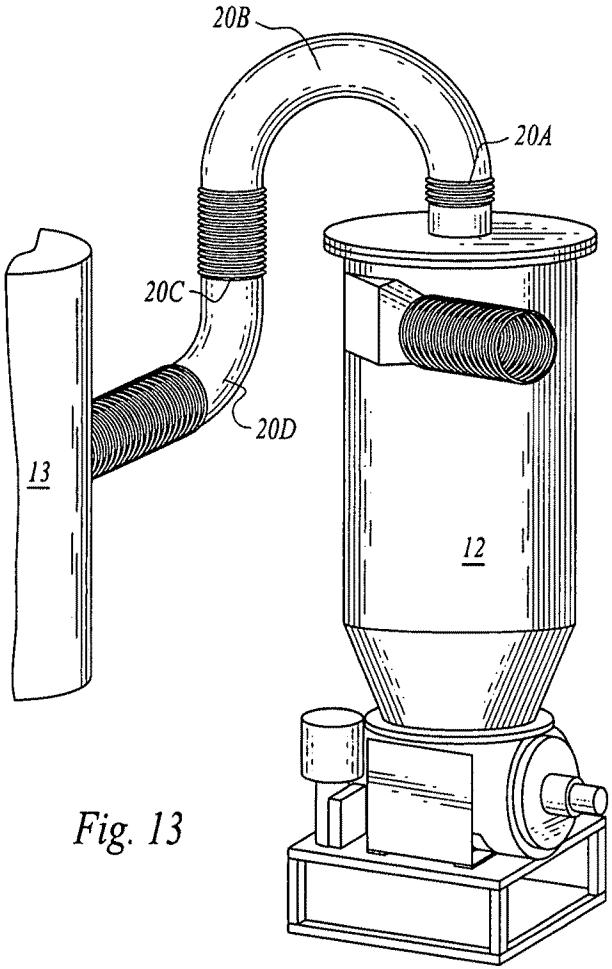
FIG. 13 is a perspective view of cyclonic separator #2, the input thereto from separator #1, and the output tube from separator #2.

Designator 107 is the storage area of the forward and the trailer which is above the fifth wheel connection. A plurality of extra hoses 108 and fiberglass bags 109 are seen stowed in area 107. Also seen in this view is silencer cylinder 38 which will be discussed infra. Reference may be made to FIG. 13 for another viewing of many of the elements discussed with respect to FIG. 11

In the stage II cyclone, the rubber drops out of the bottom of the cyclone 12 into rotary valve 17 and then out the bottom of the valve into a collection bags 109, such as seen supra. The trash goes out hose 20 into the side of the air filter 13. Most likely however, the rubber will be deposited into a drop chamber 14, to be blown back to the range, due to the large number of bags needed and the speed of processing. See the FIG. 1 discussion.

Figure 15:
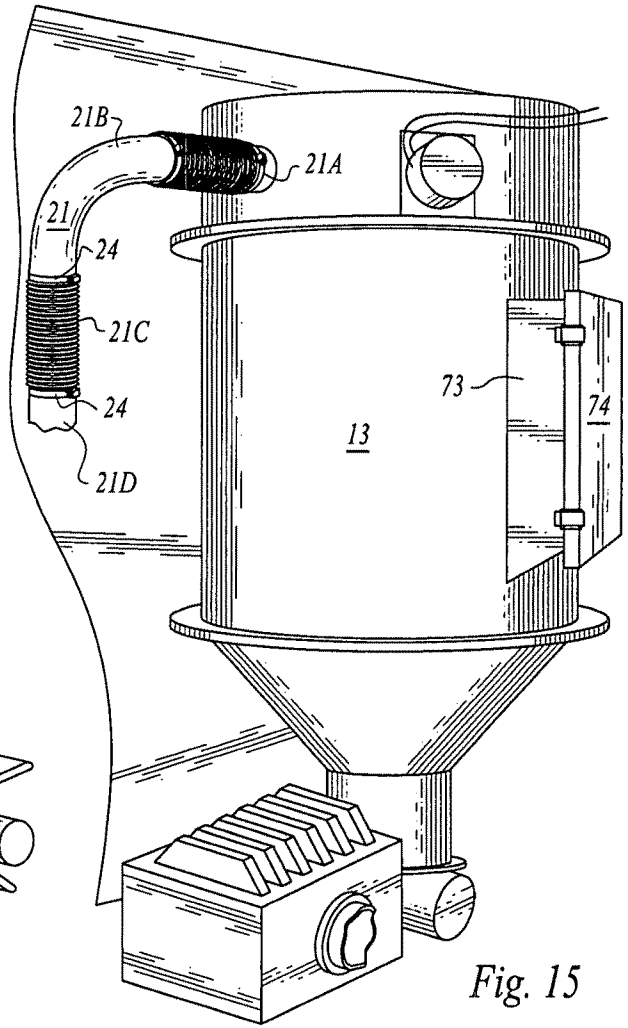
FIG. 15 is a cartridge air filter mechanism and the output tube therefrom

The discussion now tends to FIG. 13. Seen in the upper left corner of FIG. 13 is a mechanism 45 that houses a series of poppet valves—not shown since these are convention. A poppet valve (also called mushroom valve) is a commonly available valve typically used to control the timing and quantity of gas or vapor flow. Here the valves are used to bring compressed air sequentially to each of the air filter cartridges present, to clean the air filter mechanism of trash only, as the lead and then the rubber have been segregated and collected in the first two stages. Further discussion concerning the filter apparatus will take place relevant to FIG. 15.

FIG. 13 is related to FIG. 11. Thus we see the output flexible hose 19 from stage I which is also the input for the second stage, 12 for the removal and separation of the rubber present. Stage II is also a cyclonic separator wherein the mixture of rubber and trash answers at port 12 the with the rubber dropping down to the rotary valve 17 and the trash going upwardly through exhaust pipe 20. In this construction exhaust pipe 20 comprises a flexible hose section 20 fluidly connected to topically 12 a of the cyclone on one end and connected to the U-shaped tube 20B on the other. 520 Bay is connected to an intermediate card dated section 20C on one end, and which card dated section is connected to elbow 20D which in turn is connected to flex section 20E. The second end of the flex section 20 is connected to a non-visible part of the filter stage, 13, which is also designated the third stage. In other embodiments of this invention the connection between stage II and stage III could be simplified if more physical space were present such that intermediate flex tubing might not be necessary.

Figure 14:
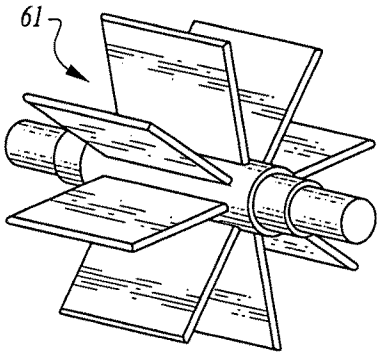
FIG. 14 is a typical rotary valve removed from its housing, three of which type of valve are employed in the process and components hereof.

FIG. 14 is a diversion from the discussion of the various stages. It depicts one format of a rotary valve mechanism. This one has eight fins whereas others may have anywhere from four to six fins, all of which configurations of such valves are deemed conventional.

Figure 16:
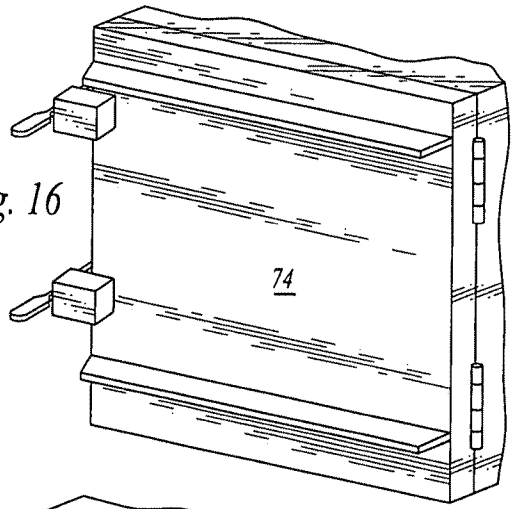
FIG. 16 is the front door of the air filter system, with a portion of a cylindrical blower's silencer seen in the view in front of the air filter.
Figure 17:
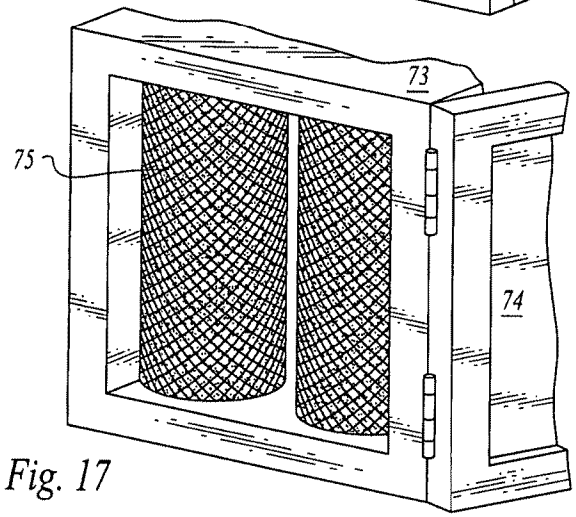
FIG. 17 is view showing the air filter's hinged door open to expose the cartridges therein.

The discussion now moves to the third stage which is the filtration stage. The cartridge air filter mechanism 13 includes an entry area 73 and a tangible door 74. This door is also seen in FIG. 16. In FIG. 17 the closed door of FIG. 16 is shown in open position to reveal a plurality of cartridges within the confines of the air filter 13. The discussion now returns to FIG. 15 in view of the fact that the mode of cleaning the air filter cartridges has been explained supra briefly. This is because cartridge filter systems are deemed conventional in the art.

As was seen in FIG. 13 exhaust air and trash particles enter near the bottom of the third stage. The trash drops out the bottom while the air moves through the cartridges, is cleaned and passes out the exhaust manifold 21 at the top of the filter stage. In this embodiment exhaust manifold 21 comprises a connection to a short section of flex pipe attached to an elbow 21B, which elbow 20 1B is connected at its opposite end to another flex member 20 1C. The flex member is connected to a rigid tubular member 20 1D which serves as the input to the blower to be discussed infra. Note the presence of hose clamps 24 at several locations where flex plastic pipe is connected to a rigid tubular member. As in the discussion of the connection between stage II and stage III, the element makeup that connects the filter stage, 13, to the lower 15 may be different in other physical environments.

Figure 18:
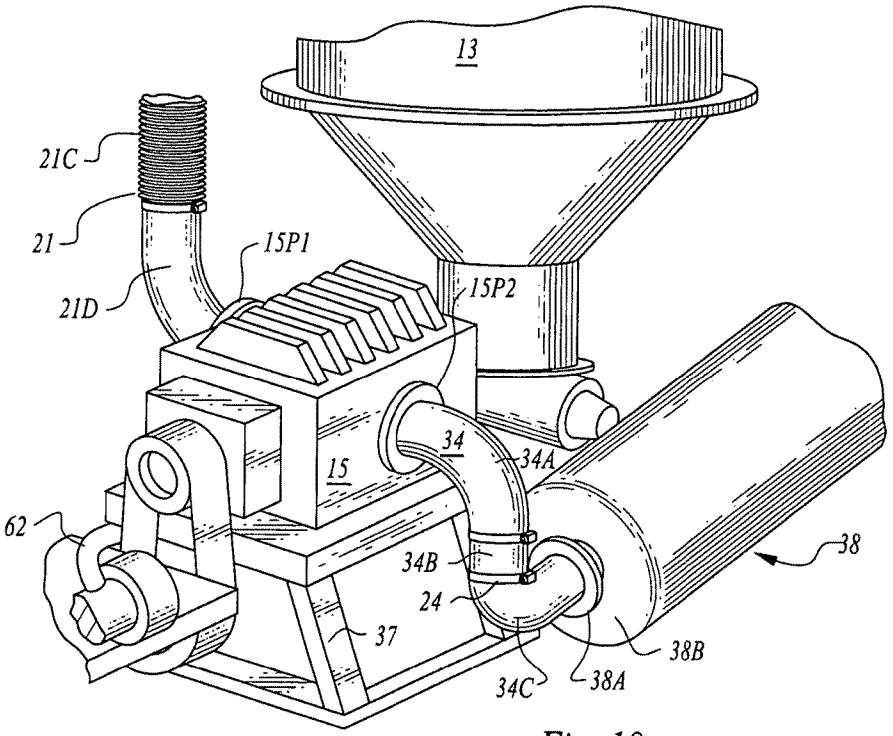
FIG. 18 is a top perspective view showing the air filter, the cylindrical silencer and the blower forward of the air filter along with the input and output of the blower. A portion of the second or left diesel engine is also seen.
Figure 19:
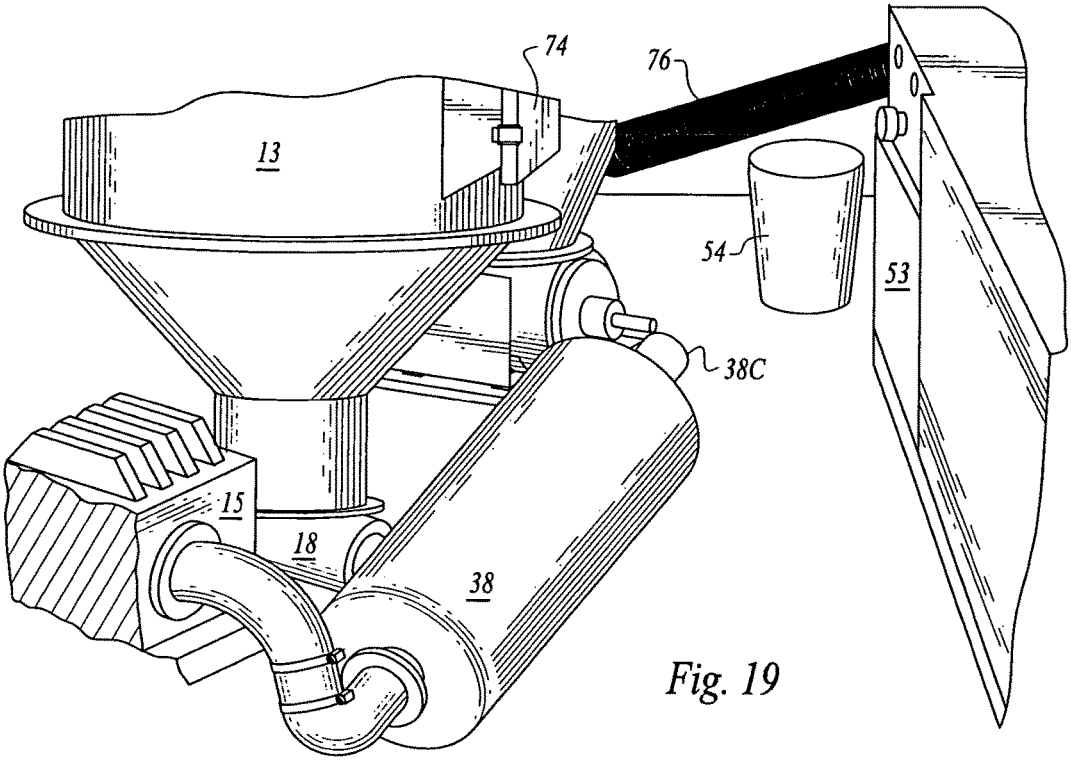
FIG. 19 is a view related to FIG. 18 showing several of the components and the width of the trailer, as well as the silencer and the fluid output hose from the silencer.

The discussion now moves to FIG. 18 wherein the primary points of focus are the Roots blower 15 and the silencer cylinder 38. Reference can simultaneously be made to FIGS. 19 and 20. As is known, the roots type supercharger or blower is a positive displacement lobe pump which operates by pumping a fluid, here air with a pair of meshing lobes not unlike a set of stretched gears. The first patented design for such a blower was done by the roots brothers back in 1860. These are commonly referred to as positive displacement blowers. Because a roots type blower pumps air in discrete pulses, unlike a screw compressor, pulsation noise and turbulence may be transmitted downstream. It is for this reason that the silencer component 38 is employed in this system, 10. Roots type blowers are readily available in many sizes and physical configurations in the marketplace from such vendors as Roots®, Gardner-Denver and Duroflow® among others. It is within the skill of the art to determine the correct sizing of the blower which is used to return the rubber particles to the range site or in the alternative a collection bag.

Here the blower 15, has an input connection. 15 P1 which connects to elbow 20 1D and an output connection plate 15 P2 which connects to output 34 toward the silencer cylinder 38. In point of fact, output 34 comprises an elbow 34 a fluidly connected to an intermediate flexible pipe section 34B which in turn is also connected to a second elbow section 34C that connects to the silencer's input plate 38 A. Note also the presence of hose clamps 24 to ensure fluid type connections between rigid pipe and flexible material.

The clean air from the blower 15 as noted can be quite noisy and as such is sent through a commercially available silencer 38 to reduce the decibel level for those working on or near the trailer. It is within the skill of the art to match a commercially available silencer of the proper size to the noise level of a particular Roots type blower being employed. One vendor of silences for Roots blowers known to applicant is the New York Blower Company located in Willowbrook, Ill.

Stand 37 is employed conventionally to reduce vibration from the blower. If the blower had been mounted directly to the floor of the trailer, there would be excessive vibration. Blower 15 is operated by the conventional diesel engine 62 shown in part at the lower left corner of FIG. 18.

The air being silenced is directed via output 38C to the bottom of the $2^{nd}$ stage rotary valve to blow the cleansed rubber back onto the range, via a pipe not seen, but located at the lower front of the trailer.

Figure 20:
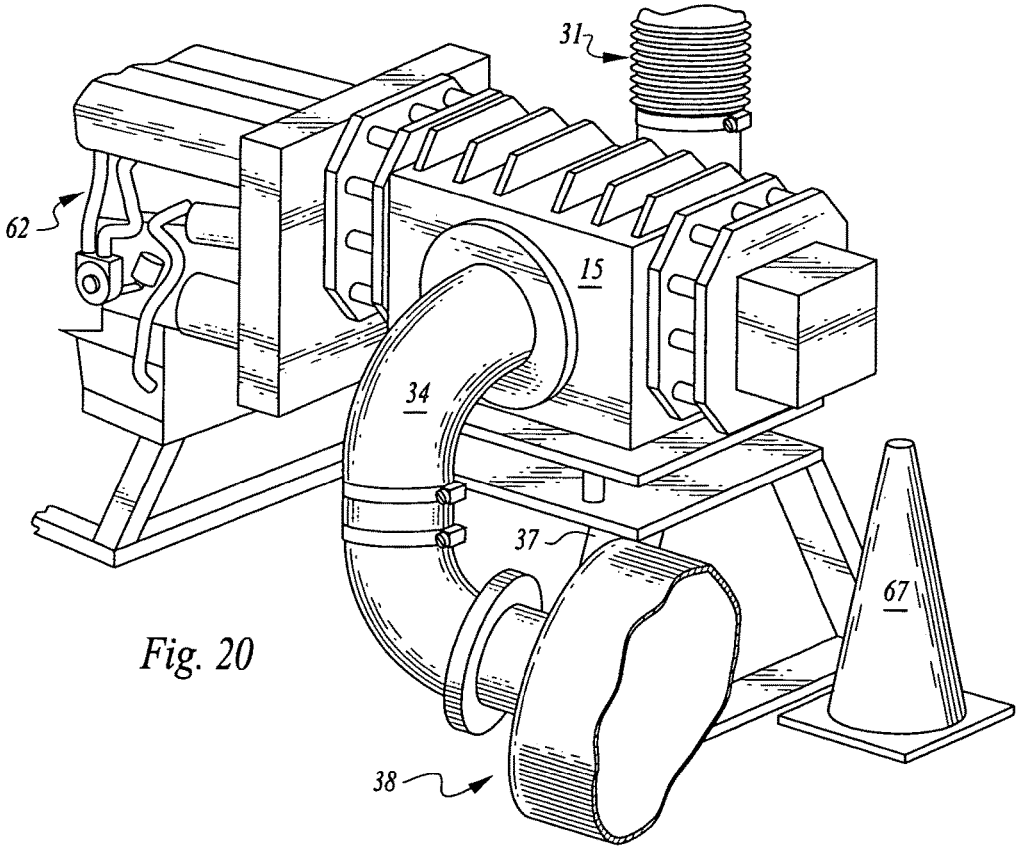
FIG. 20 is a perspective view taken from the rear interior of the trailer and which shows the blower, a portion of the silencer, and the second diesel engine.
Figure 22:
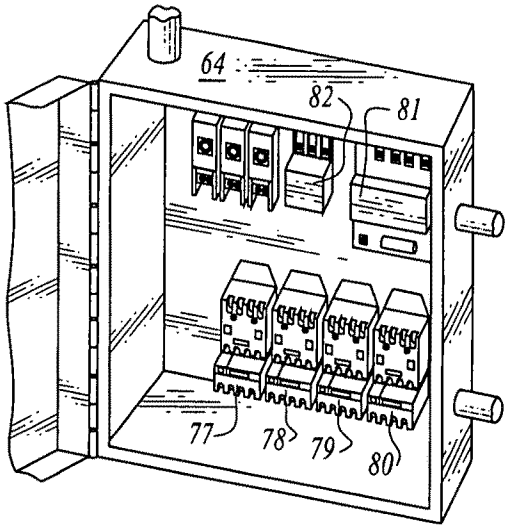
FIG. 22 shows the controller box of FIG. 21 open to reveal its contents.

Turn now to FIG. 20. This is a view of all or part of the components found in the left side of the trailer. Closer to the entrance of the trailer adjacent the roots blower is diesel engine 62, which is used to power the blower. Cone 67 forms no direct part of the invention but is considered auxiliary to the safe operation of the trailer when placement is at location where uninvited persons could potentially inhibit or impact the carrying out of the duties of the technicians who operate components of the trailer.

Figure 21:
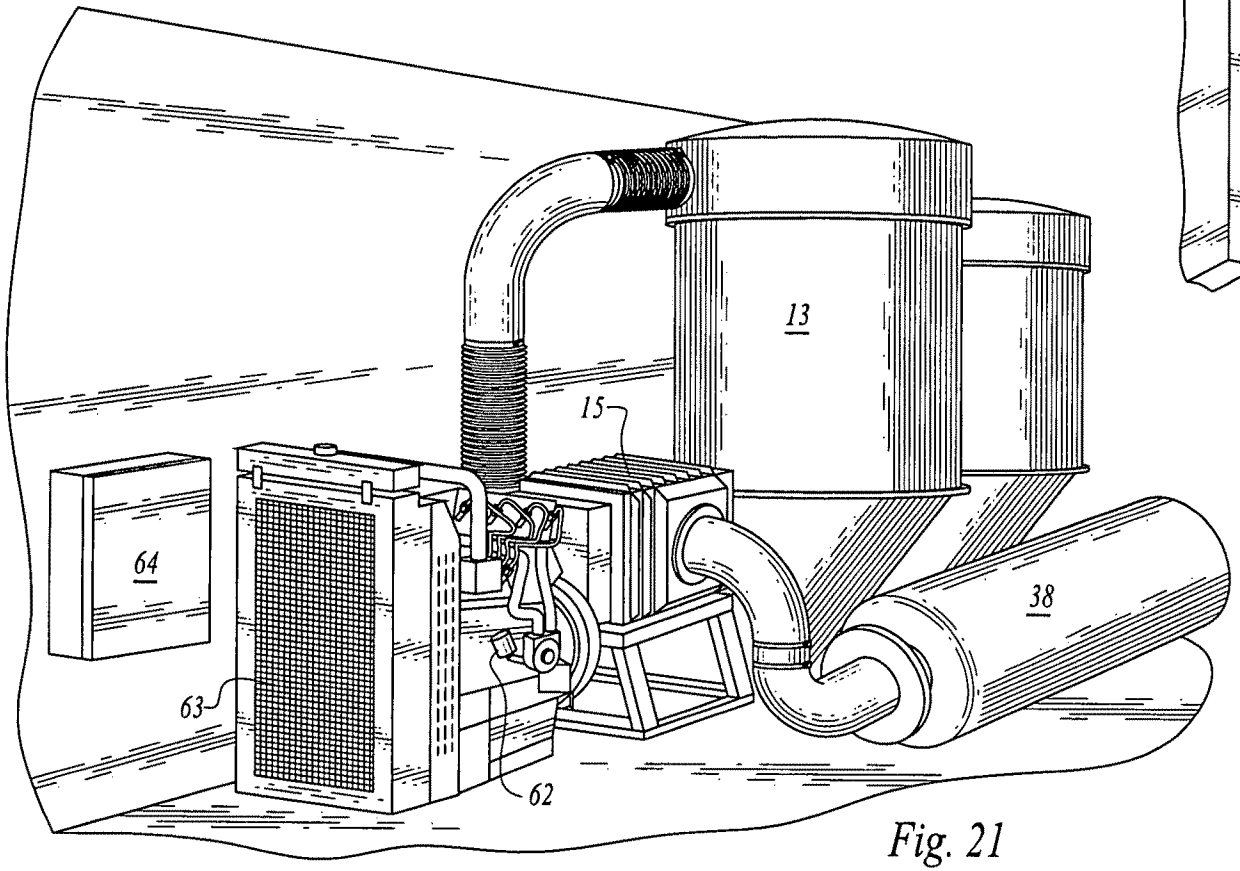
FIG. 21 is a front perspective view of the components seen in FIG. 20 as well as showing a wall mounted controller unit.

FIG. 21 is a perspective view of the left side components within the trailer as seen from the area of the right rear door of the trailer. In addition to the components previously discussed which include diesel engine 62 for blower 15 as well as the air filter system 13, one sees control box 64 wall-mounted near the radiator portion of the diesel engine. Within box 64 are seen for controls for rotary valves only three of which are actually connected and designated 77-80. Also seen in electrical box 64 is the diesel engine control 52 which is electrically connected to the diesel engine that supplies power to the blower. A transformer to change the power from 480 V to 110 V power is present as designator 81.

Figure 24:
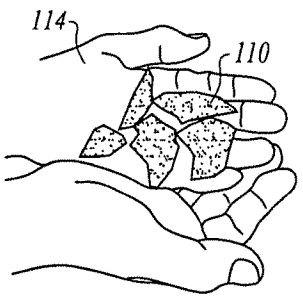
FIG. 24 is the inventor's hands holding large rubber chunks ready for redeposit on the gun range grounds.
Figure 23:
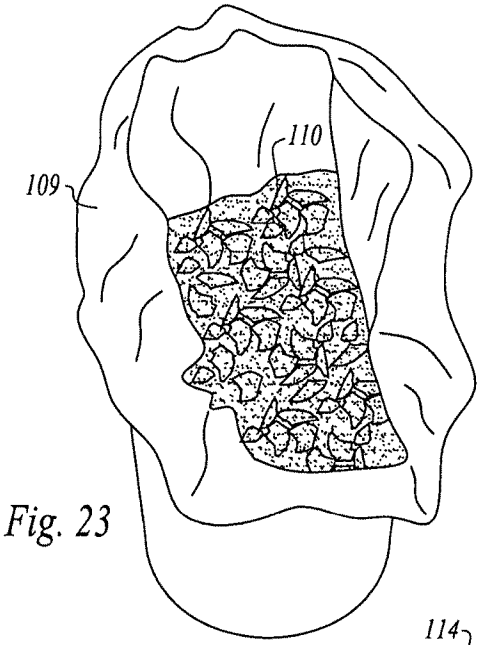
FIG. 23 is a top perspective view of a fibreglass collection bag for rubber chunks.

FIG. 23 depicts a conventional fiberglass bag 109 having collected chunks of rubber 110 therein. Some of these chunks 110 are seen in the hands, 114 of one of the technicians who provide range remediation services in FIG. 24.

FIG. 25 as mentioned earlier is a top plan view of the trailer components showing their relative location within the trailer even the silencer 38 is shown.

Returning momentarily to FIG. 1A it should be noted that the vibrating screen 31 is a conventionally available means for particle size separation techniques, a process well known to the art. Vibrating screens for particle size separation are readily available in the marketplace from several manufacturers.

While not specifically recited, it is to be understood that the cyclonic separators must be operating to carry out the separations set forth herein. In addition, while cyclonic separators may function without the rotary valves attached, in the process and system of this invention the rotary valves are required, other wise the system would be open and would not function, as the needed air pressure to carry out the separations would be lost if the bottom of each separator were open to the atmosphere. Each rotary valve utilized herein is driven by an electric motor, and a chain or gear drive. Such operation is deemed conventional. Thus the motors and gear systems are neither shown nor discussed.

Figure 26:
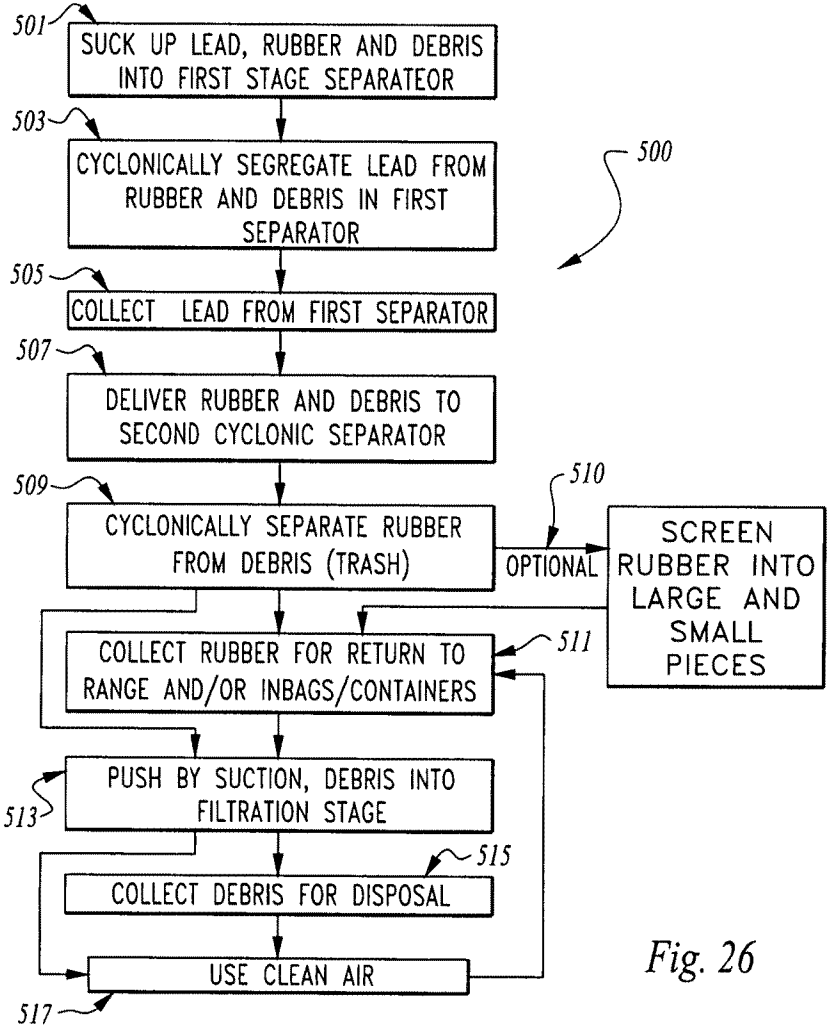
FIG. 26 is a black box diagram of the process of this invention and the variant process as well.

The process of this invention, 500, is set forth in FIG. 26. Step 501 pertains to the acquisition of the lead, and rubber chunks and debris from the indoor or outdoor firing range. The mixture is introduced into the first stage separator designated 11 in FIG. 1. Here, step 503 consists of cyclonically separating the lead from the rubber and debris. The lead is collected from the first separator according to step 505. The rubber in the first stage separator is delivered with the debris according to step 507 to the second cyclonic separator. Here, per step 509 the rubber is cyclonically separated in the second stage 12 per FIG. 1. Optionally, according to step 510 a vibrating screen may collect the rubber particles of all sizes and segregate them into large and small pieces of rubber as may be desired this is in accordance with the use of the components shown in FIG. 1A. The next step is 511 wherein the rubber from step 509 and/or 510 is collected for return to the range or for storage as may be desired. The debris is moved from the second stage to the third stage, the filter apparatus 13 by suction. The debris is collected in step 515 and the now clean air is used to disperse the rubber particles to the range via step 517.

No specific size is designated for the rubber chunks segregated, as the sizing will be dependent upon what the range owner used in the range construction.

It is seen that I have developed a new and relatively low-cost operation for the remediation of gun ranges located both interiorly and outside using the same trailer and component equipment thereon. It is believed that the process of cleaning up gun ranges using the equipment within the trailer as discussed is also new and unique.

It is to be understood that the size and manufacturer of individual components may vary greatly as may be desired. But one must bear in mind that these components are heavy and that space is limited in a trailer as to width of the trailer, in order to ensure that the trailer can move from place to place on US highways.

Since certain changes may be made in the above described apparatus without departing from the scope of the invention herein involved, it is intended that all matter contained in the above description and in the accompanying drawings, if present, shall be interpreted as illustrative only and not in a limiting sense.

I claim:

1. A system for cleaning up gun ranges having a mix of trash, rubber chunks and lead pieces thereon, which system comprises:

a. a first cyclonic separator having an input and having a bowl shaped plate with a central opening disposed across the diameter of the interior of said separator, said separator also having a first output and a second output, said second output connected to a b. first rotary valve at the bottom of the first separator, through which lead can drop out for collection;

c. a second cyclonic separator fluidly connected directly and only to the first output of said first cyclonic separator and said second separator having a first output fluidly connected to a filter apparatus, and a second output connected to a d. second rotary valve at the bottom of the second separator, through which rubber can drop out;

e. a drop chamber to receive the dropped rubber chunks, and further including a third rotary valve fluidly connected to the second output of the filter apparatus, and wherein the first output of the filter system is fluidly connected to a Roots type Blower to pressurize the filtered air for reuse.

2. The system of claim 1 wherein the cleansed pressurized air is fluidly introduced into the drop chamber, which drop chamber has an output hose attached thereto, whereby rubber chunks deposited in said drop chamber can be redistributed onto the gun range by the pressurized air.

3. The system of claim 2 further including a silencer to reduce the noise from the Roots type blower, said silencer being fluidly connected and interposed between the Roots type blower and the drop chamber.

4. A system for cleaning up gun ranges having a mix of trash, rubber chunks and lead pieces thereon, which system comprises:

a. a first cyclonic separator having an input and having a bowl shaped plate with a central opening disposed across the diameter of the interior of said separator, said separator also having a first output and a second output, said second output connected to a b. a first rotary valve at the bottom of the first separator, through which lead can drop out for collection;

c. a second cyclonic separator fluidly connected to the first output of said first cyclonic separator and said second separator having a first output fluidly connected to a filter apparatus, and a second output connected to a d. to a second rotary valve at the bottom of the second separator, through which rubber can drop out;

e. a drop chamber to receive the dropped rubber chunks, and further including a third rotary valve fluidly connected to the second output of the filter apparatus, and wherein the first output of the filter system is fluidly connected to a Roots type Blower to pressurize the filtered air for reuse and wherein the cleansed pressurized air is fluidly introduced into the drop chamber, which drop chamber has an output hose attached thereto, whereby rubber chunks deposited in said drop chamber can be redistributed onto the gun range by the pressurized air.

5. The system of claim 4 further including a silencer to reduce the noise from the Roots type blower, said silencer being fluidly connected and interposed between the Roots type blower and the drop chamber.

* * * * *